US010301095B2

(12) United States Patent
Rodrigues et al.

(10) Patent No.: US 10,301,095 B2
(45) Date of Patent: May 28, 2019

(54) CONTAINER HAVING OUTER HOUSING AND INNER PACKAGE

(71) Applicant: Altria Client Services LLC, Richmond, VA (US)

(72) Inventors: Luiz Andre Rodrigues, Neuchatel (CH); Onesio Luis Thesing, Ecublens (CH)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 0 days.

(21) Appl. No.: 15/856,813

(22) Filed: Dec. 28, 2017

(65) Prior Publication Data

US 2018/0186538 A1 Jul. 5, 2018

Related U.S. Application Data

(63) Continuation of application No. PCT/EP2017/084171, filed on Dec. 21, 2017.

(30) Foreign Application Priority Data

Dec. 30, 2016 (EP) ..... 16207642

(51) Int. Cl.
*B65D 5/66* (2006.01)
*B65D 77/04* (2006.01)
*B65D 77/20* (2006.01)

(52) U.S. Cl.
CPC ..... *B65D 77/0433* (2013.01); *B65D 77/204* (2013.01); *B65D 5/6626* (2013.01); *B65D 2577/043* (2013.01)

(58) Field of Classification Search
CPC .. B65D 77/043; B65D 77/0413; B65D 77/04; B65D 77/00; B65D 77/204;
(Continued)

(56) References Cited

U.S. PATENT DOCUMENTS 4,925,035 A 5/1990 Hunninghaus
2002/0162757 A1 11/2002 Parsons
(Continued)

FOREIGN PATENT DOCUMENTS

DE 2339103 A1 2/1975
EP 0307833 A2 3/1989
(Continued)

OTHER PUBLICATIONS

Machine Translation, DE 2339103 (Year: 1973).*
(Continued)

*Primary Examiner* — Steven A. Reynolds
*Assistant Examiner* — Javier A Pagan
(74) *Attorney, Agent, or Firm* — Harness, Dickey & Pierce, P.L.C.

(57) ABSTRACT

The container includes an outer housing with a top wall, a bottom wall, a front wall, a back wall, a first side wall, and a second side wall. The top wall defines an access opening for providing access to the interior of the outer housing. An inner package is disposed within the outer housing, and includes a recessed base and a cover member overlying the recessed base, which together form a sealed enclosure for one or more consumer goods. The inner package is held in a fixed position within the outer housing such that a first portion of the inner package underlies the top wall and a first portion of the cover member underlies and is exposed by the access opening. The first portion of the cover member is separable from the remainder of the inner package to allow removal of consumer goods.

15 Claims, 2 Drawing Sheets

(58) Field of Classification Search
CPC ..... B65D 77/2032; B65D 77/2028; B65D 77/2024; B65D 77/20; B65D 77/10
See application file for complete search history.

(56) References Cited

U.S. PATENT DOCUMENTS

| | | | | |
|---|---|---|---|---|
| 2014/0318999 | A1* | 10/2014 | Liang | B65D 5/0095 206/349 |
| 2016/0120744 | A1* | 5/2016 | Hammond | B65D 83/0463 206/531 |
| 2016/0198764 | A1 | 7/2016 | Suss et al. | |

FOREIGN PATENT DOCUMENTS

| | | | |
|---|---|---|---|
| EP | 2099685 | A1 | 9/2009 |
| EP | 2845498 | A1 | 3/2015 |
| EP | 3251972 | A1 | 12/2017 |
| ES | 2068087 | A2 | 4/1995 |
| GB | 1577593 | A | 10/1980 |
| GB | 2269366 | A | 2/1994 |
| GB | 2532952 | A | 6/2016 |
| WO | WO-2003/053794 | A1 | 7/2003 |
| WO | WO-2017/036991 | A1 | 3/2017 |
| WO | WO-2017/207412 | A1 | 12/2017 |
| WO | WO-2017/207668 | A1 | 12/2017 |

OTHER PUBLICATIONS

Extended European Search Report #16207642.6 dated May 26, 2017.

International Search Report and Written Opinion thereof dated Mar. 13, 2018 in corresponding International Application No. PCT/EP2017/084171.

* cited by examiner

CONTAINER HAVING OUTER HOUSING AND INNER PACKAGE

CROSS-REFERENCE TO RELATED APPLICATION

This application claims priority to international application number PCT/EP2017/084171, filed on Dec. 21, 2017, and further claims priority under 35 USC § 119 to European patent application number 16207642.6, filed Dec. 30, 2016, the entire contents of each of which are incorporated herein by reference.

BACKGROUND

Example embodiments relate to a container for consumer goods having improved structure for accessing the consumer goods. The container has a particular application as a container for aerosol generating articles or elements of aerosol generating articles.

DESCRIPTION OF RELATED ART

Aerosol generating articles and other consumer goods can be packaged in a container formed from folded laminar blanks. Consumer goods are commonly sold in hinge lid packs having a box for housing the consumer goods and a lid connected to the box about a hinge line extending across a wall of the container. Such packs are typically constructed from laminar cardboard blanks. In use, the lid is pivoted about the hinge line to open the pack and expose an access opening in the box, through which the consumer can gain access to the consumer goods held within the box.

It can be advantageous to preserve original properties such as moisture content, flavor or freshness of the consumer goods until a consumer accesses them.

SUMMARY

At least one example embodiment is directed toward a container for consumer goods.

In one embodiment, the container includes, an outer housing including, a top wall, a bottom wall, a front wall, a back wall, a first side wall, and a second side wall, wherein the top wall defines an access opening for providing access to an interior of the outer housing; and at least one first inner package disposed within the outer housing, the at least one first inner package including, a recessed base, and a cover member overlying the recessed base, the recessed base and the cover member being configured to form a sealed enclosure for at least one first consumer good, the at least one first inner package being affixed in a fixed position within the outer housing such that a first portion of the at least one first inner package underlies the top wall of the outer housing, and a first portion of the cover member underlies and is exposed by the access opening, wherein the first portion of the cover member is at least partially separable from a remainder of the at least one first inner package to allow for removal of the at least one first consumer good through the access opening.

In one embodiment, the recessed base of the at least one first inner package includes, a recessed portion, and a flange extending along an upper edge of the recessed portion, wherein the flange forms at least part of the first portion of the at least one first inner package that underlies the top wall of the outer housing.

In one embodiment, the cover member is overlying both the recessed portion and the flange of the recessed base.

In one embodiment, the flange extends along a first plane that is substantially parallel to a second plane, the top wall of the outer housing existing in the second plane.

In one embodiment, at least part of the upper edge of the recessed portion of the recessed base substantially coincides with at least part of a perimeter of the access opening.

In one embodiment, the cover member of the at least one first inner package extends beyond the recessed base of the at least one first inner package to define a pull tab that underlies and is exposed by the access opening.

In one embodiment, the cover member of the at least one first inner package defines a line of weakness that delineates an edge of the first portion of the cover member.

In one embodiment, the line of weakness is disposed within about 4 millimeters of a perimeter of the access opening.

In one embodiment, the container further includes a cover flap connected to the outer housing along a first hinge line, wherein the cover flap is movable between a closed position in which the access opening on the top wall of the outer housing is at least partially covered and an open position in which the access opening on the top wall of the outer housing is exposed.

In one embodiment, the cover flap includes, a first panel connected to the bottom wall of the outer housing by the first hinge line, and a second panel connected to the first panel, the second panel being configured to cover the access opening on the top wall of the outer housing when the cover flap is in the closed position.

In one embodiment, the container further includes a closure mechanism for retaining the cover flap in the closed position.

In one embodiment, the closure mechanism includes a microsuction structure.

In one embodiment, the access opening in the top wall of the outer housing is a cut out.

In one embodiment, upon first opening the container, the container is configured to have the access opening at least partially covered by a removable portion of the top wall of the outer housing, the removable portion being defined by one or more lines of weakness in the top wall of the outer housing.

In one embodiment, the at least one first inner package includes two or more inner packages disposed within the outer housing, the recessed bases and cover members of the respective two or more inner packages combining to form a sealed enclosure for the at least one first consumer good.

In one embodiment, the access opening defines a common access region for the two or more inner packages within the container.

BRIEF DESCRIPTION OF THE DRAWINGS

Example embodiments will now be described with reference to the accompanying drawings.

DETAILED DESCRIPTION

Figure 1:
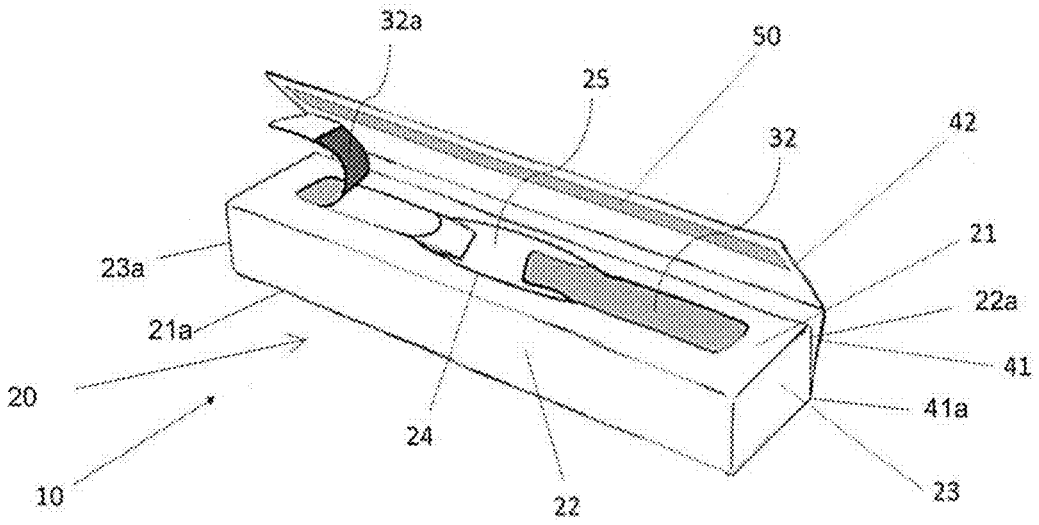
FIG. 1 illustrates a perspective view of a container, in accordance with an example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, and/or elements, but do not preclude the presence or addition of one or more other features, integers, steps, operations, elements, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, regions, layers and/or sections, these elements, regions, layers and/or sections should not be limited by these terms. These terms are only used to distinguish one element, region, layer or section from another region, layer or section. Thus, a first element, region, layer or section discussed below could be termed a second element, region, layer or section without departing from the teachings set forth herein.

Spatially relative terms, such as "beneath", 'below', "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Example embodiments provide a container for consumer goods including: an outer housing with a top wall, a bottom wall, a front wall, a back wall, a first side wall, and a second side wall, wherein the top wall defines a perimeter of an access opening in the top wall for providing access to the interior of the outer housing; and an inner package disposed within the outer housing, and including: a recessed base and a cover member overlying the recessed base, which together form a sealed enclosure for one or more consumer goods. The inner package is held in a fixed position relative to the outer housing such that a first portion of the inner package underlies the outer housing top wall and a first portion of the cover member underlies and is exposed by the access opening. The first portion of the cover member is at least partially separable from the remainder of the inner package to allow for removal of the one or more consumer goods through the access opening.

Example embodiments provide an inner package including: a recessed base and a cover member overlying the recessed base, which together form a sealed enclosure for one or more consumer goods, the one or more consumer goods can be suitably preserved until a consumer is ready to access them. By arranging for the inner package to be held in a fixed position relative to the outer housing such that a first portion of the inner package underlies the outer housing top wall and a first partially portion of the cover member underlies and is exposed by the access opening, a consumer is able to access and remove the goods from the container without having to remove the inner package from the outer housing. In particular, a consumer can use the access opening in the outer housing to pull on the first portion of the cover member to at least partially separate it from the remainder of the inner package. At the same time, the first portion of the inner package that underlies the outer housing top wall will prevent the entirety of the inner package from being removed through the access opening, and thus allow the consumer to gain access to the consumer goods without having to separate the inner package from the outer housing. Consequently, the consumer goods can be suitably preserved by the inner package, and easily removed from the container when desired, whilst also benefiting from the presence of an outer housing that may be more practical for the likes of stacking and transporting the consumer goods. Further, the additional outer packaging allows additional space for conveying information concerning the consumer goods to a consumer. In addition, because the recessed base is retained within the container in a convenient position after one or more consumer goods have been removed from the inner package, a consumer has the option of re-using the recessed base if desired; for example, by storing fully or partially used consumer goods in the recessed based. This can be particularly advantageous in instances where the consumer goods are aerosol generating articles or elements of aerosol generating articles (or, vapor generating articles and/or elements) that are re-used or recycled. In general, in the use of blister containers, a broken cover web can remain attached to the blister, where this type of packaging can typically be perceived as unattractive. It can be advantageous to have a first portion of the cover member that can be fully separated from the remainder of the inner package.

In this document, the terms "side", "top", "bottom", "front", "back" and other terms used to describe relative positions of the elements of the container refer to the container in an upright position with the access opening at the top. When describing the example embodiments, these terms are used irrespective of the orientation of the container being described. The "bottom" of the container refers to the side of the container opposite the "top" of the container. Where the container has a hinged lid, the direction in which the lid opens is the "back" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional elements of the container of the example embodiments, for example to a reinforcing member provided in the form of an inner frame.

The term "hinge line" is used herein to refer to a line about which the lid flap may be pivoted in order to open the container. A hinge line may be, for example, a fold line or a score line. The hinge line about which the lid flap is connected to the box may coincide with an edge of the container, or the hinge line may extend across a wall of the container at a position that is spaced apart from the edges.

The term "inner surface" is used throughout the specification to refer to the surface of an element of the assembled container that is facing towards the interior of the container, for example towards the consumer goods, when the container is in the closed position. The term "outer surface" is used throughout the specification to refer to the surface of an element of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "lines of weakness" is used herein to describe a portion of a surface of the package (or the blank from which the package is formed) wherein the structural strength of the material, from which the package (or blank) is formed has been weakened by any suitable technique, for example with respect to bending, folding or tearing along the line of weakness. For example, a line of weakness may be formed as a scoring line, a creasing line, an ablation line, or a perforation line. Lines of weakness can be created by removal of material, by displacement of material, by compression of material, by locally reducing the forces that hold the material together, such as by breaking fibres in a fibrous material, as well as by combinations of all the above. A line of weakness may be straight, curved, segmented or continuous or a combination thereof. In many instances, a line of weakness is used to assist in positioning a fold line in a blank. A line of weakness can also be used to strengthen the material in a direction perpendicular to the line of weakness, for example by compression. Further, a line of weakness can be used for decorative purpose.

The term "scoring line" is used to describe a line formed by partially cutting into the material of the blank. A scoring line may be formed by removing material from the blank (in which case the scoring line forms a groove or trough in the blank). In an alternative example embodiment, a scoring line may be formed without removing any material from the blank, which may involve a partial sideways displacement and compression of material, caused by a knife with a non-zero thickness penetrating the material. The depth of the scoring line will be less than the thickness of the blank.

The term "creasing line" is used to describe a line formed by displacing a portion of the material vertical to the plane of the blank, forming a groove or trough in the blank. The displacement may involve compression and typically involves the use of a compression tool, such as a roller. In an alternative example embodiment, or in addition to the other example embodiments, the material in the creasing line may be displaced so as to at least partially protrude from the opposite side of the blank. No material may be removed when a creasing line is formed.

The term "ablation line" is used to describe a line formed by removing material from a surface of the blank to a determined depth by way of ablation (for example, by way of a laser beam or a blade).

The term "perforated line" is used to describe a line or sequence of discrete holes or slots in the blank. The holes may be formed by pushing an object through the blank. In an example embodiment, material may be removed from the blank, for example by punching. In an alternative example embodiment, the holes can be created without removing material, and instead simply using the object to push the material outwardly from the center of the hole. In another alternative example embodiment, the holes may be formed by way of a laser beam.

The term "fold line" is used to describe any line of a blank about which the blank is folded. The fold line may be defined by a line of weakness to assist with the folding action. In an alternative example embodiment, a fold can be formed without the presence of a weakening line. In such example embodiments, a fold line can be typically defined by the end points between the fold forms when bending the sheet like material, depending for example on the pliability of the blank material and other material characteristics.

In an example embodiment, the cover member may have the form of a flexible sheet-like material. The cover member may be a single layer sheet or a multilayer sheet. The cover member may be a foil.

In an example embodiment, the recessed base includes a recessed portion and a flange extending along an upper edge of the recessed portion, wherein the flange forms at least part of the first portion of the inner package, which underlies the outer housing top wall. This can advantageously help the inner package to stay in a fixed position relative to the housing, particularly when first portion of the cover member is being at least partially separated from the remainder of the inner package.

The flange may extend along only part of the upper edge of the recessed portion. In an embodiment, the flange may extend around along at least two sides, and alternatively around at least three sides of recessed portion.

The flange may be formed integrally with the recessed portion, for example by forming the flange and recessed portion from moulded plastic. In an example embodiment, the flange may be a separate piece that is attached to the recessed portion, for example, by means of an adhesive.

The recessed base may be formed of any material or combination of materials. In an example embodiment, the recessed base is formed from a plastic material.

In an example embodiment, at least a portion of the recessed base is formed from a transparent or substantially transparent material, and all of the recessed base may be formed from a transparent or substantially transparent material. For example, the recessed base may be formed from a transparent plastic. In such example embodiments, the interior of the outer housing can advantageously be used to convey information to the consumer, with said information becoming visible once one or more consumer goods are removed from the respective recessed base. In an alternative example embodiment, or in addition to the example embodiments, indicia such as text, graphics or logos may be provided in the inner surface of the recessed base, for example in the form of print or embossing. The cover member may overlay only the recessed portion. In an example embodiment, the cover member overlays both the recessed portion and the flange. This can be advantageous from a manufacturing perspective. For example, during manufacture, a single initial web of material could be applied across a number of interconnected recessed portions, which are then cut to form one or more recessed bases. This reduces the need for precise alignment between the cover member and the recessed portion.

The inner package may be held in a fixed position relative to the outer housing by any suitable structure. In an example embodiment, the inner package may be sized such that it abuts against the inner surfaces of portions of opposing walls, such as the front and back wall of the outer housing, to restrict relative movement between the inner package and the outer housing. In an alternative embodiment, or in addition to the example embodiments, an adhesive may be used to secure the inner package in place relative to the housing.

Where the recessed base include a flange, the flange may extend along a plane that is substantially parallel to the plane of the outer housing top wall. This can help to form a good engagement between the flange and the housing top wall, and thereby help to reduce potential movement between the inner package and the outer housing. This can also allow for a precise alignment between the edge of the access opening and the edge of the recess or the outer dimension of the partially removable first portion of the cover member. The flange may be further secured to the housing by means of an adhesive.

In an example embodiment, at least part of the upper edge of the recessed portion may substantially coincide with and underlie at least part of the perimeter of the access opening. That is, at least part of the upper edge of the recessed portion may have a profile that corresponds to at least part of the profile of the perimeter of the access opening, and said part of the upper edge of the recess portion may substantially underlie said part of the perimeter of the access opening. For example, a part of the perimeter may be U-shaped and a part of the upper edge of the recessed portion may follow the same profile as the U-shape of the perimeter. In such embodiments, the inner package may be disposed within the outer housing and held in a fixed position relative to the outer housing such that the U-shaped part of the upper edge of the recessed portion substantially underlies the U-shaped part of the perimeter of the access opening. Such example embodiments can advantageously allow for the recessed portion to appear as a continuation of the access opening. The part of the upper edge of the recessed portion that substantially underlies at least part of the perimeter of the access opening may have any alternative shape or profile, such as triangular shaped, trapezoidal, diamond shaped, oval, etc.

In an example embodiment, the cover member may extend beyond the recessed base to define a pull tab that underlie and is exposed by the access opening. The pull tab can help at least partially separate the first portion of the cover member from the remainder of the inner package.

In an example embodiment, the first portion of the cover member can be at least partially separated from the remainder of the inner package, by virtue of the cover member extending beyond the access opening and thus under at least a portion of the outer housing top wall. In such an example embodiment, the perimeter of the access opening can therefore act to define a dividing edge along which the first portion of the cover member can be separated from the remainder of the inner package. This is particularly advantageous where the cover member material is made from a flexible material, such as polymeric material, in which a rip could otherwise propagate in any direction, even with the presence of a weakening line. However, due to the alignment of the perimeter and the access opening, the top wall of the container may create a clear mechanical guide to the tearing of the cover member when the recessed base is opened for the first time.

In an example embodiment, the cover member can be provided with a line of weakness that defines an edge of the first portion of the cover member. The line of weakness may be disposed at any point that underlies the perimeter of the access opening, at any point that underlies the access opening itself, or at any point that underlies the outer housing top wall.

In an example embodiment, the line of weakness is disposed within about up to 4 millimeters of the perimeter of the access opening, or in an alternative example embodiment within about up to 2 millimeters of the perimeter of the access opening.

In an example embodiment, the line of weakness may underlie the access opening itself. This can allow the at least partially removable first portion of the cover member to move entirely, without obstruction, through the access opening, during opening. In an alternative embodiment, especially in embodiments where the at least first portion of the cover member is entirely removed from the recessed base, it is advantageous that the line of weakness is disposed underneath the top wall of the outer housing. In these example embodiments, the parts of the cover member that are not removed, will remain hidden beneath the top wall of the outer housing after removal of the at least first portion of the cover member.

In an example embodiment, the line of weakness may follow a profile that substantially corresponds to the profile of at least a part of the perimeter of the access opening. This can advantageously help to provide at least a part of the first portion of the cover member with a profile that substantially corresponds to at least a part of the profile of the access opening. In an example embodiment, the line of weakness in the cover flap may follow a profile that substantially corresponds to the profile of the perimeter for between about 40 percent and about 95 percent of the length of the perimeter, or, the line of weakness in the cover flap may follow a profile that substantially corresponds to the profile of the perimeter for between about 60 percent and about 90 percent of the length of the perimeter.

In an example embodiment, the container further includes a cover flap connected to the outer housing along a first hinge line, wherein the cover flap is movable between a closed position in which the access opening on the outer housing top wall is at least partially covered and an open position in which the access opening on the outer housing top wall is exposed. In an example embodiment, the access opening is completely covered when the cover flap is in the closed position.

The cover flap may include a single panel. In such an example embodiment, the first hinge line may extend along the top edge of the outer housing back wall.

In an alternative example embodiment, the cover flap may include two or more panels. In another example embodiment, the cover flap includes a first panel connected to the bottom wall of the outer housing by the first hinge line, and a second panel connected to the first panel, wherein the second panel of the cover flap is configured to at least partially cover the access opening on the outer housing top wall, when the cover flap is in the closed position. In an example embodiment, the first panel is connected to the back edge of the bottom wall of the outer housing by the first hinge line.

The second panel may be connected to the first panel by a second hinge line, in which case the second panel can pivot relative to the first panel. In an alternative example embodiment, the second hinge panel may be held at a fixed angle relative to the first, such as 90 degrees.

In an example embodiment, the container further includes a closure mechanism for retaining the cover flap in the closed position. The closure mechanism may provide a resealable structure that retains a secure closure before first opening of the container and also enables repeated opening and closing of the cover flap between uses. The closure mechanism may be provided on the cover flap, on the one or more housing walls that underlie the closure flap in the closed position, or both. The closure mechanism may provide proximate at least one of the edges of the cover flap, to improve the seal between the cover flap and the corresponding housing wall or walls.

The closure mechanism may take any suitable form. In an example embodiment, the closure mechanism includes a microsuction structure.

The term "microsuction structure" is used herein to refer to an article including a flexible material having a plurality of micro cavities on the material's external surface. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface. The microsuction structure can therefore provide an effective structure for securing the cover flap in the closed position relative to the housing.

The micro cavities may have a diameter of from 5 microns to 300 microns. The material may be formed of an expanded resin having a plurality of internal air bubbles. The material may be provided as a layer of a sheet-like article on the surface of the container. The layer may have a thickness of from 30 microns to 500 microns. The sheet-like article may include one or more additional layers, such as a layer for securing the material layer to the surface of the container.

In an example embodiment a microsuction structure is provided on a first surface of the cover flap, and a microsuction structure is provided on a corresponding first surface of the housing. This can enhance the retention effect provided by the microsuction structures as they can attach to each other when the cover flap is in the closed position. In an alternative embodiment, the microsuction structure is provided on only one of the first surface of the cover flap or the first surface of the housing.

In alternative example embodiments, the closure structure may include a resealable adhesive or a magnet provided between the contacting surfaces of the cover flap and the housing.

In an alternative example embodiment, or in addition to the described example embodiments of the closure mechanisms described above, the closure mechanism may include a closure tab extending from an edge of the cover flap and a corresponding slit in the housing for receiving the closure tab when the cover flap is in the closed position. For example, the cover flap may be provided with a closure tab depending from the front edge of the cover flap, which is received into a slit provided at the front edge of the housing top wall.

The access opening provided in the outer housing top wall of the container provides the opening through which the consumer goods can be removed from the container. The access opening may take any suitable form to enable convenient removal of the consumer goods within the box.

In an example embodiment, the access opening is a cut out provided in the outer housing top wall. The access opening is therefore incorporated into the container during the manufacturing process and is present when the container is provided to a consumer.

In an alternative embodiment, the access opening is at least partially covered by a removable element which is at least partially removed by the consumer upon first use of the container, in order to gain access to the consumer goods. For example, upon first use of the container the access opening may be at least partially covered by a removable portion of the outer housing top wall defined by one or more lines of weakness. The lines of weakness may be configured to define a removable panel that is detachable from the outer housing and is therefore intended to be fully removed by the consumer. In an alternative embodiment, the lines of weakness may be configured to define a removable panel that is removed from the access opening but remains attached to the outer housing along at least one edge. For example, the removable panel may be removed and folded away from the access opening. In such an embodiment, it may be possible for the consumer to move the removable panel back into the original position over the access opening between uses. In such embodiments, the line of weakness can correspond to at least part of the perimeter of the access opening.

In an alternative example embodiment, the removable element may be in the form of a removable cover layer, such as a removable adhesive label, that is provided over the access opening. In contrast to the removable panel, which is an integral part of the outer housing top wall, the removable cover layer is a separate element that is applied onto the outer housing top wall to close the access opening. As with the removable panel described above, the removable cover layer may be configured to be detachable from the outer housing. Alternatively, the removable cover layer may be configured such that it remains in place on the box. In such an example embodiment, the removable cover layer can be reclosed or resealed over the access opening between uses. For example, the removable cover layer may include a resealable adhesive that enables it to be sealed back over the access opening. In an alternative example embodiment, the removable cover layer may be slidable relative to the outer housing such that it can be moved between a closed position over the access opening and an open position away from the access opening.

The shape and size of the access opening may be varied, for example, depending upon the size and shape of the consumer goods contained within the outer housing.

The outer housing may contain only one inner package, which may itself contain one or more consumer goods in its sealed enclosure.

In an example embodiment, the container may further include one or more additional inner packages disposed within the outer housing, each of the one or more additional inner packages including: a recessed base and a cover member overlying the recessed base, which together form a sealed enclosure for one or more consumer goods. Each of the one or more additional inner packages is held in a fixed position relative to the outer housing such that a first portion of each additional inner package underlies the outer housing top wall and a first portion of the cover member of each additional inner package underlies and is exposed by the access opening. The first portion of the cover member of each additional inner package is at least partially separable from the remainder of its respective inner package to allow for removal of the one or more consumer goods from each additional inner package through the access opening. In an example embodiment where one or more additional inner packages are disposed within the outer housing, the access opening may define a common access region in the container. This may be a region within the container where no inner packages are present, but where a consumer can insert their fingers into the container to interact with the cover flap on each of the inner packages and at least partially separate the first portion of the cover flap of each inner package respectively.

The common access region may be a volume of space within the container having a boundary, whereby at least a portion of the boundary of the common access region is defined by the inner package and at least one of the one or more additional packages. A portion of the boundary may be defined by the access opening. The common access region may therefore be located within the outer housing, between the inner package and at least one of the one or more additional packages. In an example embodiment, the inner package and the one or more additional inner packages are disposed around the common access region, or symmetrically disposed around the common access region. The common access region may be disposed between two inner packages. The two inner packages may be disposed on opposing sides of the common access region.

In an example embodiment, the common access region is spaced away from one or more of the outer housing front wall, back wall, first side wall and second side wall. In another example embodiment, the common access region is spaced away from at least the outer housing first side wall and the outer housing second side wall. The common access region may be spaced away from a wall of the outer housing by virtue of an inner package, or other article, being disposed within the outer housing between the common access region and said wall.

The access opening may allow access to the common access region. That is, the access opening may overlay at least a portion of the common access region, and may overlay all of the common access region.

In an example embodiment, the common access region is centrally located within the outer housing. In another example embodiment, the common access region is spaced from the outer housing first side wall by a distance that is substantially equal to the distance by which the common access region is spaced from the outer housing second side wall. In another example embodiment, the common access region is spaced from the outer housing front wall by a distance that is substantially equal to the distance by which the common access region is spaced from the outer housing back wall. The common access region may be spaced equidistantly from all of the outer housing front wall, back wall, first side wall and second side wall. The location of the common access region for the purposes of measuring a distance to a wall of the outer housing may be taken as the volumetric center of the common access region.

In an example embodiment, the width of the access opening at a portion which overlays the common access region is greater than the width of the access opening at a portion which does not overlie the common access region. The width of the access opening may be measured along a line perpendicular to the outer housing front wall and outer housing back wall.

In an example embodiment, the inner packages each include a pull tab, where the pull tab of each inner package may be adjacent to the common access region. The pull tab may therefore be accessed by a consumer by placing their fingers into the common access region. It will be appreciated that each of the one or more additional inner packages may have any combination of the features that are listed above in respect of the inner package.

In an example embodiment, the outer housing of the container is formed from one or more folded laminar blanks. The outer housing of the container may be formed from a single laminar blank. The one or more laminar blanks may be formed from any suitable material or combination of materials including, but not limited to, cardboard, paperboard, plastic, metal, laminates, coextrudates or combinations thereof.

In an example embodiment, the container contains one or more consumer goods within the sealed enclosure of the inner package. In another example embodiment, the inner package contains one or more aerosol generating articles or aerosol generating article elements. The consumer goods may be wrapped or sealed individually, or in groups.

In an example embodiment, through an appropriate choice of dimensions, the container may be designed to hold different types or numbers of consumer goods.

Example embodiments will now be further described, by way of example only, with reference to the accompanying drawings.

FIG. 1 shows a container 10, in accordance with an example embodiment. The container 10 includes an outer housing 20 formed by folding a laminar cardboard blank. The outer housing has a top wall 21, bottom wall 21*a*, a front wall 22, a back wall 22*a*, a first side wall 23, and second side wall 23*a*. The top wall 21 defines a perimeter 24 of an access opening 25 in the top wall 21 for providing access to the interior of the outer housing.

Two inner packages 30 may be disposed within the outer housing 20, and each may include a recessed base 34 (see FIGS. 2A-2C) and a cover member 32 overlying the recessed base 34, which together form a sealed enclosure for one or more consumer goods 60. One of the inner packages 30 is shown in an open configuration, whereas the other is shown in a closed configuration. In the arrangement of FIG. 1 the two inner packages 30 are disposed on either side of a common access region (shown as access opening 25) in the container 10. This is a region within the container 10 where no inner packages are present, but where a consumer can insert their fingers into the container to interact with the cover flap 32 on each of the inner packages 30 and at least partially separate the first portion of the cover flap of each inner package 30, respectively.

As can be seen in FIG. 1, for the inner package 30 to be in the open configuration, at least a first portion 32*a* of the cover member 32 has been at least partially separated from the remainder of the inner package to allow for removal of the one or more consumer goods 60 through the access opening 25.

The container 10 of FIG. 1 further includes a cover flap 41/42 connected to the outer housing 20 along a first hinge line 41*a* that extends along the bottom edge of the outer housing back wall 22*a*. The cover flap 41/42 is movable between a closed position in which the access opening 25 on the outer housing top wall 21 is at least partially covered and an open position in which the access opening 25 on the outer housing top wall 21 is exposed. The cover flap 41/42 includes a first panel 41 connected to the bottom wall of the outer housing by the first hinge line 41*a*, and a second panel 42 connected to the first panel 41, and wherein the second panel 42 of the cover flap 41/42 is configured to cover the access opening 25 on the outer housing top wall 21, when the cover flap 41/42 is in the closed position.

Figures 2A, 2B, 2C:
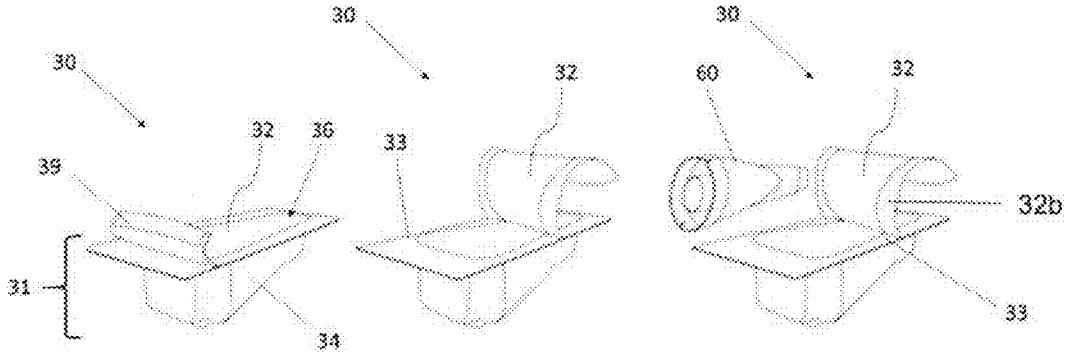
FIG. 2A illustrates a perspective view of the inner package of the container of FIG. 1, in a stage of opening, in accordance with an example embodiment.
FIG. 2B illustrates a perspective view of the inner package of the container of FIG. 1, in another stage of opening, in accordance with an example embodiment.
FIG. 2C illustrates a perspective view of the inner package of the container of FIG. 1, in another stage of opening, in accordance with an example embodiment.

FIGS. 2A-2C illustrate perspective views of the inner package 30 of the container 10 of FIG. 1 in different stages of opening. In particular, FIG. 2A illustrates the inner package 30 upon initial opening, where a pull tab 39 of the cover member 32 has been initially lifted. FIG. 2B illustrates the inner package 30 after a first portion of the cover member 32 has been partially separated from the remainder of the inner package 30. FIG. 2C illustrates the configuration of FIG. 2B, but where a consumer good 60 has been removed from within the inner package 30.

As can be seen from FIGS. 2A-2C, the inner package 30 includes a cover member 32 that overlays a recessed base 31. The recessed base 31 includes a recessed portion 34 and a flange 33 that extends around the upper edge of the recessed portion 34.

In the embodiment of FIGS. 2A-2C, the cover member 32 overlays the entirety of the recessed base 31 and is affixed to the flange 33 of the recessed base 31 by a structure that is a resealable adhesive 32*b*. This enables the cover member 32 and the recessed base 31 to form a resealable enclosure. However, as shown in FIG. 1, by arranging for at least a first portion of the inner package 30, such as the rear part 36 of the inner package 30 to underlay the outer housing top wall 21, a consumer is able to access and remove the goods 60 from the container 10 without having to remove the inner package 30 from the outer housing 20. In particular, a consumer can use the access opening 25 in the outer housing 20 to pull on the first portion of the cover member 32 to at least partially separate it from the remainder of the inner package 30. At the same time, at least the rear portion 36 of the inner package 30 that underlays the outer housing 20 top wall 21 can prevent the entirety of the inner package 30 from being removed through the access opening 25, and thus allow the consumer to gain access to the consumer goods 60 without having to separate the inner package 30 from the outer housing 20.

Figure 3:
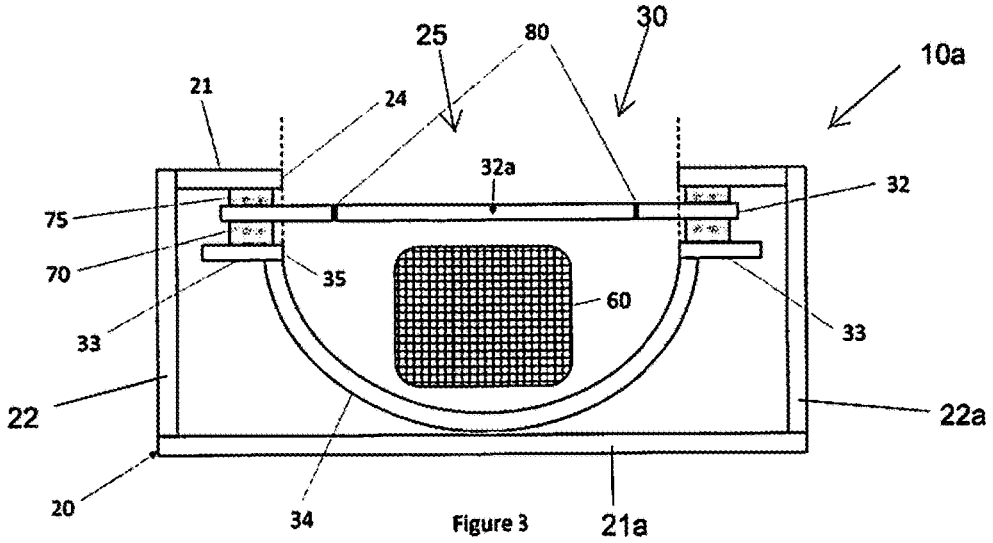
FIG. 3 illustrates a cross-sectional view of an inner package, in accordance with another example embodiment.

A cross-sectional view of container 10*a* according to another example embodiment is shown in FIG. 3. The cross-sectional view is not shown to scale—for example, items such as the adhesive areas 70 and 75 have been enlarged for enhanced visibility.

As with the container 10 of FIG. 1, the container 10*a* of FIG. 3 has an outer housing 20 and an inner package 30 disposed within the outer housing 20. The inner package 30 has a recessed base 33/34 including a recessed portion 34 and a flange 33 that extends around the upper edge 35 of the recessed portion 34. A cover member 32 overlays the recessed portion 34 and the flange 33 and is affixed to the flange 33 by the structure of an adhesive 70. This forms a sealed enclosure for one or more consumer goods 60. Although not necessarily shown in FIG. 3, the dimensions of the inner package and the outer housing 20 are such that the inner package 30 is held in the outer housing 20 in a fixed position. Furthermore, the inner package 30 is further held with respect to the outer housing 20 by way of an adhesive 75 between the cover member 32 and the inner surface of the outer housing top wall 21.

As shown by the dotted lines in FIG. 3, at least part of the upper edge 35 of the recessed portion 34 substantially coincides with at least part of the perimeter 24 of the access opening 25. In FIG. 3, cover member 32 is provided with at least one line of weakness 80 that extends along a portion of the cover member 32 at a point that underlays the access opening 25. The lines of weakness 80 define the edges of the first portion of the cover member 32*a* that is at least partially separable from the remainder of the inner package 30. Consequently, in the example embodiment of FIG. 3, when the first portion 32*a* of the cover member 32 is removed by separating it from the remainder of the inner package 30 by tearing along the lines of weakness 80, some of the cover member 32 will remain visible through the access opening 25. In an example embodiment, the line of weakness 80 is disposed within about up to 4 millimeters of the perimeter of the access opening 25, or in an alternative example embodiment within about up to 2 millimeters of the perimeter of the access opening 25.

Figure 4:
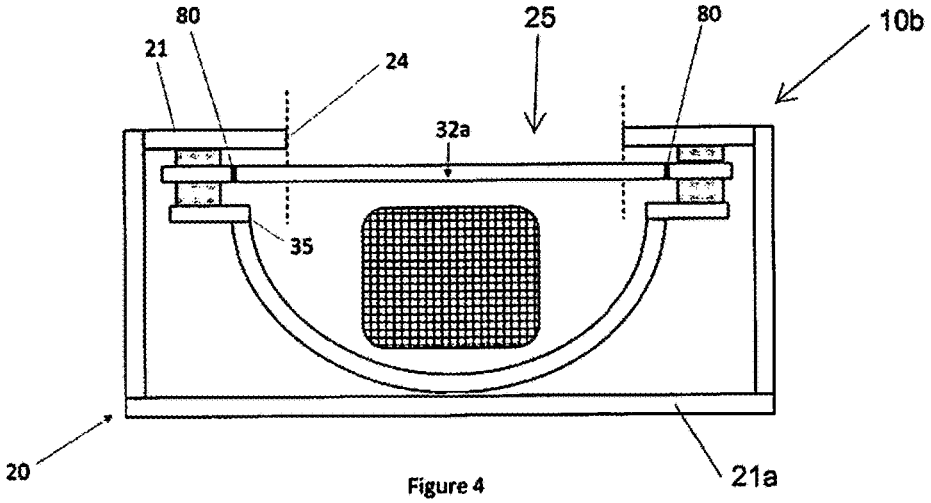
FIG. 4 illustrates a cross-sectional view of an inner package, in accordance with another example embodiment.

A cross-sectional view of container 10*b* according to another example embodiment is shown in FIG. 4. The embodiment of FIG. 4 is the same as that of FIG. 3, except in FIG. 4, at least part of the upper edge 35 of the recessed portion 34 does not substantially coincide with at least part of the perimeter 24 of the access opening 25. Furthermore, in FIG. 4, there are also lines of weakness 80 that define the edges of the first portion of the cover member 32*a* that is at least partially separable from the remainder of the inner package 30. However, in FIG. 4, said lines of weakness now extend along a portion of the cover member 32 at a point that underlays the top wall 21 of the outer housing 20. Consequently, in the example embodiment of FIG. 4, when the first portion 32*a* of the cover member 32 is removed by separating it from the remainder of the inner package 30 by tearing along the lines of weakness 80, the parts of the cover member 32 that are not removed, will remain hidden beneath the top wall 21 of the outer housing 20. In an example embodiment, the line of weakness 80 is disposed within about up to 4 millimeters of the perimeter of the access opening 25, or in an alternative example embodiment within about up to 2 millimeters of the perimeter of the access opening 25.

Figure 5:
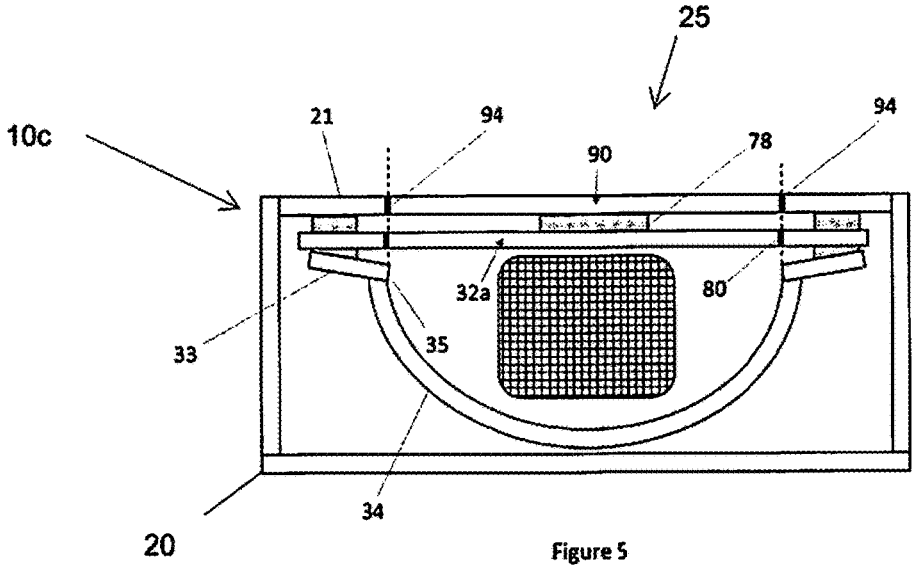
FIG. 5 illustrates a cross-sectional view of an inner package, in accordance with another example embodiment.

FIG. 5 depicts a cross-sectional view of a container 10*c* according to another example embodiment. The arrangement of FIG. 5 may be illustrative of a configuration that the container 10*c* is in prior to a consumer first using the container 10*c*.

The example embodiment of FIG. 5 is the same as that of FIG. 3, except that in FIG. 5, the flanges 33 are oriented at a slight angle relative to the plane of the outer housing 20 top wall 21. Furthermore, in FIG. 5, a removable element 90 now occludes the access opening 25 in the outer housing 20 top wall 21. The removable element 90 may be an adhesive label. However, in FIG. 5, the removable element 90 is provided in the form of a removable portion 90 of the outer housing 20 top wall 21 that is defined by one or more lines of weakness 94. The removable portion 90 is attached to the first portion 32*a* of the cover member 32 by means of an adhesive 78. Consequently, when the container 10*c* is first opened to access the consumer goods 60, the removable portion 90 is pulled to separate the removable portion 90 from the outer housing top wall 21 along the lines of weakness 94 to define the access opening 25 of the outer housing top wall 21. The adhesive 78 causes the first portion 32*a* of the cover member 32 to also separate from the remainder of the inner package 30 along lines of weakness 80. This results in the consumer goods 60 being exposed at the access opening 25.

In the arrangement of FIG. 5, at least part of the upper edge 35 of the recessed portion 34 substantially coincides with at least part of the perimeter of the access opening 25 that is defined by the lines of weakness 94. In addition, the lines of weakness 80 that define the edges of the first portion 32*a* of the cover member 32 also substantially coincides with said upper edge 35 and said access opening perimeter. Consequently, once the removable element 90 and first portion 32*a* of the cover member have been removed, the outer housing top wall 21 and inner surface of the recessed portion 34 can have the appearance of a continuing surface.

The specific embodiments and examples described above illustrate but do not limit the example embodiments. It is to be understood that other embodiments may be made, and the specific embodiments and examples described herein are not exhaustive.

The invention claimed is:

1. A container for consumer goods, comprising:

an outer housing including, a top wall, a bottom wall, a front wall, a back wall, a first side wall, and a second side wall, wherein the top wall defines an access opening for providing access to an interior of the outer housing;

at least one first inner package disposed within the outer housing, the at least one first inner package including, a recessed base, and a cover member overlying the recessed base, the recessed base and the cover member being configured to form a sealed enclosure for at least one first consumer good; and a cover flap connected to the outer housing along a first hinge line, the cover flap being movable between a closed position in which the access opening is at least partially covered and an open position in which the access opening is exposed, the cover flap including, a first panel connected to the bottom wall of the outer housing by the first hinge line, and a second panel connected to the first panel, the second panel being configured to at least partially cover the access opening when the cover flap is in the closed position, the at least one first inner package being affixed in a fixed position within the outer housing such that a first portion of the at least one first inner package underlies the top wall of the outer housing, and a first portion of the cover member is exposed by the access opening, wherein the first portion of the cover member is at least partially separable from a remainder of the at least one first inner package to allow for removal of the at least one first consumer good through the access opening.

2. The container of claim 1, wherein the recessed base of the at least one first inner package includes, a recessed portion, and a flange extending along an upper edge of the recessed portion, wherein the flange forms at least part of the first portion of the at least one first inner package that underlies the top wall of the outer housing.

3. The container of claim 2, wherein the cover member is overlying both the recessed portion and the flange of the recessed base.

4. The container of claim 2, wherein the flange extends along a first plane that is substantially parallel to a second plane, the top wall of the outer housing existing in the second plane.

5. The container of claim 2, wherein at least part of the upper edge of the recessed portion of the recessed base substantially coincides with at least part of a perimeter of the access opening.

6. The container of claim 1, wherein the cover member of the at least one first inner package extends beyond the recessed base of the at least one first inner package to define a pull tab that is exposed by the access opening.

7. The container of claim 1, wherein the cover member of the at least one first inner package defines a line of weakness that delineates an edge of the first portion of the cover member.

8. The container of claim 7, wherein the line of weakness is disposed within about 4 millimeters of a perimeter of the access opening.

9. The container of claim 1, comprising:

a closure mechanism for retaining the cover flap in the closed position.

10. The container of claim 9, wherein the closure mechanism includes a microsuction structure.

11. The container of claim 1, wherein the access opening in the top wall of the outer housing is a cut out.

12. The container of claim 1, wherein prior to first opening the container, the container is configured to have the access opening at least partially covered by a removable portion of the top wall of the outer housing, the removable portion being defined by one or more lines of weakness in the top wall of the outer housing.

13. The container of claim 1, wherein the at least one first inner package includes two or more inner packages disposed within the outer housing, each recessed bases and cover members of the respective two or more inner packages combining to form a sealed enclosure for the at least one first consumer good.

14. The container of claim 13, wherein the access opening defines a common access region for the two or more inner packages within the container.

15. The container of claim 1, wherein the first hinge line is configured to allow the first panel to articulate away from the back wall if the cover flap is in the opened position and allow the first panel to contact and lie along the back wall if the cover flap is in the closed position.

* * * * *